US006418705B2

(12) United States Patent
Machnik

(10) Patent No.: US 6,418,705 B2
(45) Date of Patent: Jul. 16, 2002

(54) METHOD OF AUTOMATICALLY SEPARATING A ROVING UPON REMOVAL OF A BOBBIN FROM A ROVING FRAME

(75) Inventor: Franz Machnik, Göppingen (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/760,218

(22) Filed: Jan. 11, 2001

(30) Foreign Application Priority Data

Jan. 14, 2000 (DE) ..... 100 01 351

(51) Int. Cl.[7] ..... D01H 9/16; D01H 9/14
(52) U.S. Cl. ..... 57/278; 242/475.8; 57/276
(58) Field of Search ..... 242/475.8; 57/276, 57/278

(56) References Cited

U.S. PATENT DOCUMENTS

| | | | | |
|---|---|---|---|---|
| 5,117,621 A | * | 6/1992 | Feichtinger et al. | 57/278 |
| 5,331,799 A | * | 7/1994 | Weeger | 57/278 |
| 5,524,428 A | * | 6/1996 | Locatelli et al. | 57/276 |
| 5,575,141 A | * | 11/1996 | Genevray | 57/278 |

FOREIGN PATENT DOCUMENTS

| | | |
|---|---|---|
| BE | 554 010 A | 1/1957 |
| DE | 35 09 338 | 9/1986 |
| DE | 39 31 124 | 3/1991 |
| DE | 195 12 578 | 10/1996 |
| DE | 196 31 756 | 2/1998 |
| DE | 197 33 614 A | 4/1998 |

OTHER PUBLICATIONS

Patent Abstracts of Japan, vol. 8, No. 102 and JP 59 015521 A (Jan. 26, 1984) Toyoda Jido Shokki Shokki Seisakusho).

* cited by examiner

*Primary Examiner*—Andy Falik
(74) *Attorney, Agent, or Firm*—Herbert Dubno

(57) ABSTRACT

To improve the breaking of a roving between a pressing finger bed and a fully wound bobbin preliminary to a bobbin change, the roving is initially wound around the tube above the upper cone and an unwound roving reserve is formed from at least a half turn on the upper winding cone and the body. A false twist is generated to provide a weakened region so that the roving has a first segment extending from the upper edge of the upper winding cone to the lower edge thereof, a second segment extending to the weakened zone and a third segment extending from the weakened zone to the pressing finger bed. The false twist increases the number of twists per unit length in the first segment and decreases the number of twists per unit length in the second and third segments. The pressing finger is moved along the bobbin periphery and the roving is broken at the weak spot by further movement of the pressing finger relative to the bobbin.

4 Claims, 2 Drawing Sheets

METHOD OF AUTOMATICALLY SEPARATING A ROVING UPON REMOVAL OF A BOBBIN FROM A ROVING FRAME

FIELD OF THE INVENTION

My present invention relates to a method for automatically separating or parting a roving upon the removal of a fully wound bobbin from a roving frame, especially a flyer frame in which the roving is delivered to the bobbin by a pressing finger pad on a flyer and the separation or parting of the roving is effected between the pressing finger pad and the bobbin periphery.

BACKGROUND OF THE INVENTION

There are numerous techniques which have been developed for the parting of the roving between the pressing finger of a flyer of a roving frame and full roving bobbin. During the winding of the bobbin, the bobbin core or tube on the spindle is rotated and the roving is fed, usually from a drafting frame through the flyer and a pressing finger on the flyer to the pressing finger tube or bed at the tip or free end of the pressing finger, from which the roving is delivered to the tube and is wound up in a bobbin. The relative axial movement of the flyer and the spindle build a generally cylindrical body of winding in the bobbin which is flanked between conical windings at the upper and lower ends thereof.

German patent document DE 196 31 756 A1 describes one of the several known techniques for separating or parting the roving between the pressing finger of a flyer and the full roving bobbin. In this system, a piece of the roving has a relatively high number of rotations per unit length generated therein by an increase in the ratio of the flyer speed to the roving feed rate from the drafting frame in the formation of the last layer of the roving on the bobbin. The roving length of greater strength produced by controlling the flyer speed and the delivery rate of the roving from the drafting frame is followed by a reverse rotation of the bobbin to relieve the twist between the pressing finger bed and the bobbin. Whereupon, by lowering of the bobbin carriage into the bobbin removal position, the roving is broken usually at the relaxed location adjacent the pressing finger bed.

The drawback of this approach is that the location of the break in the roving on the bobbin body is not fixed and varies widely from bobbin to bobbin. Furthermore, the length of roving and hanging from the pressing finger bed also may vary widely from case to case. This lack of relatively precise break locations from bobbin to bobbin and station to station constitutes a significant drawback in the handling of the bobbin subsequently and in the winding of new bobbins on empty tubes.

OBJECTS OF THE INVENTION

It is, therefore, the principal object of the present invention to provide an improved method of breaking a roving between the pressing finger bed and the fully wound bobbin whereby the aforementioned drawbacks are avoided.

Another object of this invention is to improve the precision of parting of a roving in a flyer frame system for producing full roving bodies whereby the location of the break on the body of the bobbin and the length of roving remaining on the pressing finger bed are both determined with a higher degree of reliability and reproducibility than has hitherto been the case.

Still another object of the invention is to provide a method of breaking the roving supplied to a bobbin, upon the removal thereof such that a predetermined length of roving remains free on the pressing finger of the flyer.

SUMMARY OF THE INVENTION

These objects are attained, in accordance with the invention by first generating at least a half turn of the roving and a roving reserve above the bobbin, then unwinding the roving reserve by rotating the bobbin backwardly simultaneously with a vertical movement of the pressing finger bed along the bobbin axis to generate a weakened spot along the roving leading from the pressing finger bed by partial untwisting, then moving the pressing finger bed by a certain amount along the periphery of the bobbin, and drawing the roving taut and parting the roving in the region of the weak spot by movement of the pressing finger bed.

This system provides the advantage that the desired weak spot will form with a high degree of reliability over a predetermined segment of the roving and that after the separation an end of the desired length will remain on the pressing finger bed.

According to a feature of the invention, the reserve is formed in turns on the tube above the bobbin winding, i.e. above the upper winding cone. The reserve below the fastening turns can be treated as being formed from three segments, namely, a first segment from an upper edge of the upper winding cone to the lower edge thereof at the junction between the upper winding cone and the cylindrical body of the bobbin, a second roving segment from the lower edge of the upper winding cone to the aforementioned weakened points and a third roving segment from the weakened point to the pressing finger bed, whereby this third segment has a length corresponding to the length which is to remain hanging from the pressing finger upon removal of the full bobbin.

The reverse rotation of the roving bobbin generates a false twist which increases the number of rotations per unit length in the first segment and reduces the number of twists per unit length in the second and third segments. The movement of the pressing finger bed to a further point along the body of the bobbin can make the second and third segments of substantially equal length. The segment between the break and the finger can be strengthened by increasing the number of twists or rotations per unit length. The distance between the two locations along the periphery of the bobbin body through which the pressing finger bed is moved can correspond to the number of rotations or twists per unit length in the segment between the break location and the pressing finger bed. Finally the movement of the pressing finger bed in the same direction to a further location along the body of the bobbin effects the separation.

More particularly, the method of automatically parting a roving upon removal of a full roving bobbin from a roving flyer frame in which the roving bobbin is wound on a roving tube with upper and lower winding cones having a wound body between them as the tube is rotated and the roving is delivered by a flyer from a pressing finger bed of the flyer resting on a surface of the wound body of the bobbin comprises:

(a) generating at least half a turn of roving and a roving reserve above the bobbin by a forward rotation of the bobbin following completion of the bobbin and while retaining the roving with the pressing finger bed;

(b) unwinding the roving reserve by a reverse rotation of the bobbin to form a weakened location along the roving at a certain distance from the pressing finger bed;

(c) moving the pressing finger bed by a predetermined amount along a periphery of the bobbin; and (d) pulling on the roving by movement of the pressing finger bed, thereby parting the roving at the location.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
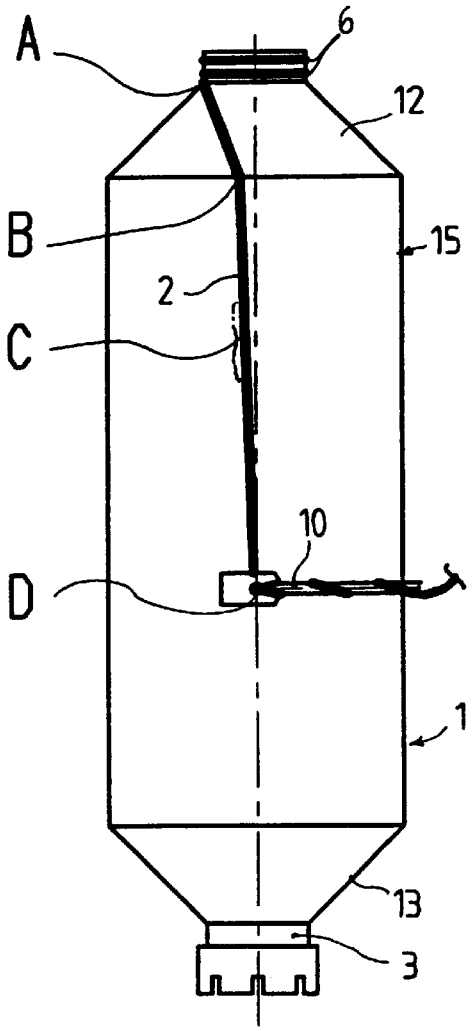
FIGS. 1–4 are diagrammatic side elevational views of a roving bobbin in various phases for the automatic parting of the roving at a particular region.

In FIGS. 1–4 a bobbin-forming station of a roving frame has been shown in schematic side view with the flyer shown only in the form of its pressing finger bed 10. The bobbin 1 is wound upon a bobbin core or tube 3 which is mounted on the spindle. The roving 2 is fed through the flyer rail and flyer from the drafting frame to the pressing finger bed 10 and is wound on the bobbin tube 3 to form the bobbin 1 which has a cylindrical body 15 between upper and lower winding cones 12 and 13.

After the bobbin 1 has reached its fully wound state, above the bobbin on the tube 3 and thus above the upper winding cone 12, two turns are wound for fixing the winding and forming a roving reserve. The length of the roving reserve is represented at A–D in FIG. 1 and can be seen as comprising three segments. A first roving segment extends from the upper edge A to the lower edge B of the upper winding cone 12. A second roving segment extends from point B to a point or region C at which location a weak spot is to be generated. The third segment extends from point C to a point D, the stretch between point C and D having a length (C–D) which corresponds to the length of the segment which is to remain hanging from the pressing finger bed 10.

Figure 2:
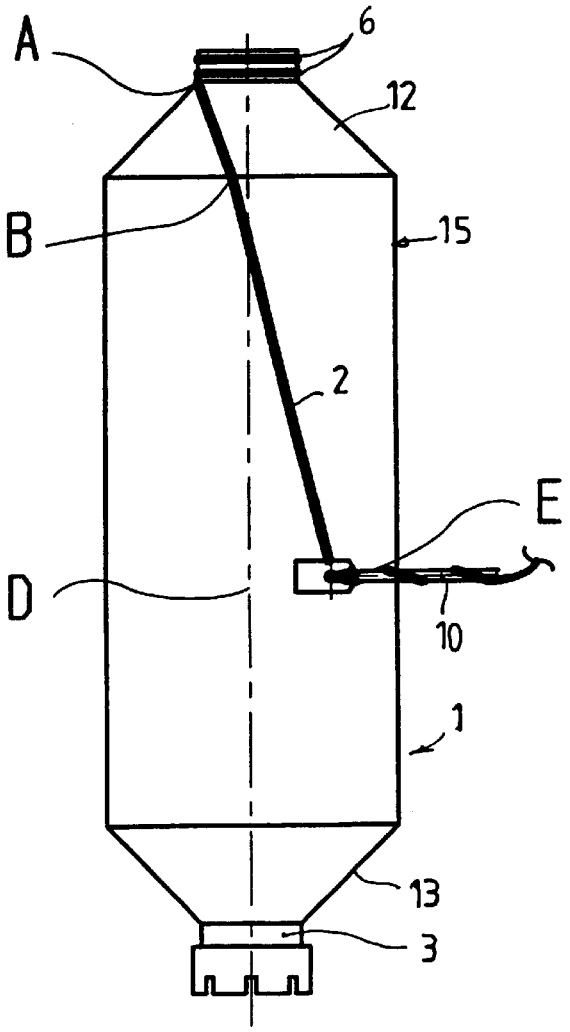

In a second stage of the process, represented in FIG. 2, the roving reserve A–D is partly unwound by a reverse rotation of the bobbin 1 and a lowering of the pressing finger bed 10 along the bobbin axis. During this unwinding operation coupled with the downward movement of the pressing finger bed, the roving 2 partly unrolls along the lower edge B of the upper winding cone 12 to generate a false twist in the roving A–D which increases the twist per unit length in segment A–B and reduces the twist in the segment B–D.

From FIG. 2 it is also apparent that in a third step the pressing finger bed 10 is moved to a location E such that the stretches B–D and B–E are of equal length. The roving thus rolls between the pressing finger bed 10 and the bobbin 1. As a consequence of the false twist, a weak spot is generated at C while the twist count increases per unit length in the region between the point C and the point E so there the roving is strengthened. From FIG. 3 it will be apparent that the length of the stretch D–E is selected so that there is a sufficient number of twists per unit length in the segment E–C.

Figure 3:
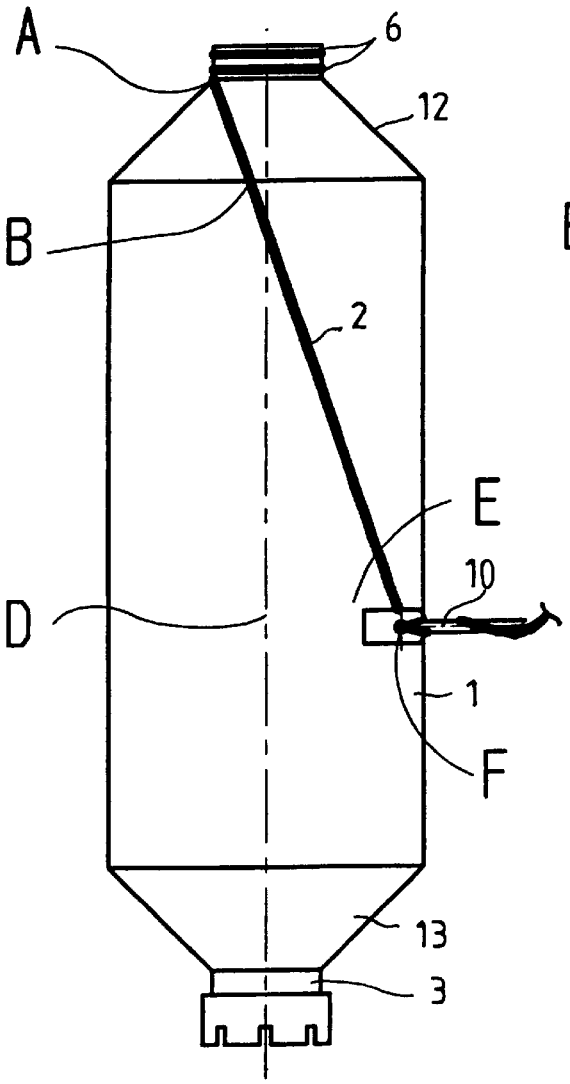
Figure 4:
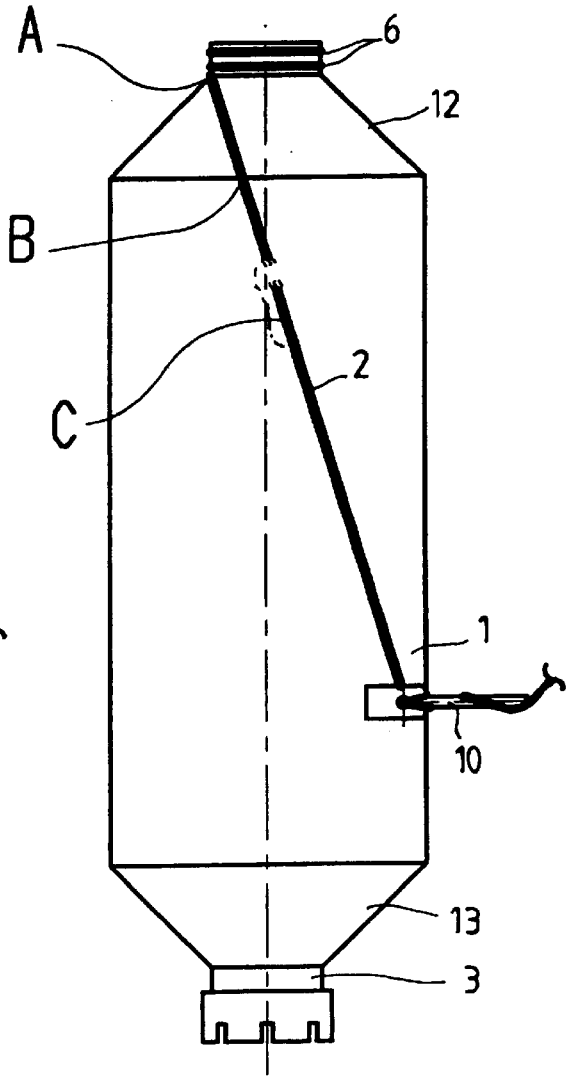

From FIGS. 3 and 4 it will be apparent that in the next stage the pressing finger 10 is moved to the point F, i.e. beyond the point E and thence to a lower point (compare FIGS. 3 and 4) so that the roving will break exactly in the weak region C. With the system of the invention, the breakage of the roving occurs with high reliability at the location C and the length of the segment C–D which remains on the pressing finger bed 10 likewise is consistent from bobbin to bobbin. The bobbin may then be removed by any conventional doffing system and the bobbins delivered to the spinning machine will also have their free ends consistently located.

I claim:

1. A method of automatically parting a roving upon removal of a full roving bobbin from a roving flyer frame in which the roving bobbin is wound on a roving tube with upper and lower winding cones having a wound body between them as the tube is rotated and the roving is delivered by a flyer from a pressing finger bed of the flyer resting on a surface of the wound body of the bobbin, said method comprising the steps of:

(a) generating at least half a turn of roving and a roving reserve on said tube above said upper winding cone by a forward rotation of the bobbin following completion of the bobbin and while retaining the roving with said pressing finger bed;

(b) unwinding the roving reserve by a reverse rotation of said bobbin to form an unwound roving reserve consisting of three segments including:

a first segment extending from an upper edge (A) of the upper winding cone to a location at a lower edge (B) of the upper winding cone, a second segment extending from the lower edge (B) of the upper winding cone to a location (C) at which the roving is to be weakened and located at a certain distance from said pressing finger bed, and a third segment extending from said location (C) to a first point (D) and corresponding in length to a desired length of roving remaining on said pressing finger after removal of the bobbin;

(c) imparting twist to said unwound roving reserve by the reverse rotation of the bobbin whereby a number of twists per unit length is increased in said first segment and is reduced in said second and third segments and the roving is weakened at said location (C);

(d) moving the pressing finger bed by a predetermined amount along a periphery of the bobbin from said first point (D) to another point (E) such that the distances (B–D) from the location at the lower edge (B) to the first point (D) and (B–E) the distance from the location at the lower edge (B) to the other point (E) are equal; and (e) pulling on said roving by movement of said pressing finger bed, thereby parting said roving at said location.

2. The method defined in claim 1, further comprising strengthening said third segment by increasing a number of twists thereof.

3. The method defined in claim 1, further comprising selecting the distance (D–E) in correspondence with the twists per unit length provided in the third segment.

4. The method defined in claim 1, further comprising parting said roving at said location (c) by moving said pressing finger bed to a further point (F) on the bobbin.

* * * * *